US005788757A

United States Patent [19]

Uchida et al.

[11] Patent Number: 5,788,757

[45] Date of Patent: Aug. 4, 1998

[54] COMPOSITION AND PROCESS USING ESTER SOLVENTS FOR FABRICATING METAL OXIDE FILMS AND ELECTRONIC DEVICES INCLUDING THE SAME

[75] Inventors: Hiroto Uchida; Nobuyuki Soyama, both of Colorado Springs, Colo.; Kensuke Kageyama; Katsumi Ogi, both of Saitama, Japan; Jeffrey W. Bacon, Colorado Springs, Colo.; Michael C. Scott, Colorado Springs, Colo.; Larry D. McMillan, Colorado Springs, Colo.; Carlos A. Paz de Araujo, Colorado Springs, Colo.

[73] Assignees: Symetrix Corporation, Colorado Springs, Colo.; Mitsubishi Materials Corporation, Japan

[21] Appl. No.: 770,991

[22] Filed: Dec. 23, 1996

[51] Int. Cl.[6] ..... C07F 19/00; C07F 3/00; C07F 9/00; C07F 9/94

[52] U.S. Cl. ..... 106/287.18

[58] Field of Search ..... 106/282.18

[56] References Cited

U.S. PATENT DOCUMENTS

| | | | |
|---|---|---|---|
| 5,034,550 | 7/1991 | Sherif | 556/54 |
| 5,434,102 | 7/1995 | Watanabe et al. | 437/130 |
| 5,514,822 | 5/1996 | Scott et al. | 556/28 |

OTHER PUBLICATIONS

Vest et al., Synthesis of Metallo–organic Compounds for Mod Powders and Films, Mat. Res. Soc. Symp. Proc. vol. 60 (1986). No month avail.

Melnick et al., Process Optimization and Characterization of Device Worthy Sol–gel Based PZT for Ferrocelectric Memories, Ferroelectrics (1990). No month avail.

*Primary Examiner*—David Brunsman

*Attorney, Agent, or Firm*—Duft, Graziano & Forest, P.C.

[57] ABSTRACT

A metal organic liquid precursor solution includes metal organic complexes dispersed in an ester solvent. The ester solvent has medium length carbon chains to prevent the precipitation of strongly electropositive metals in solution. A liquid precursor solution is used to make thin film metal oxides of uniform thickness and consistent quality.

27 Claims, 5 Drawing Sheets

$R_1 < C6$ $C6 < R_2 < C9$ $C4 < R_1 + R_2 < C12$

BRANCHED AT 2C POSITION $R_1 < C6$ $R_3 < C4$ $C1 < R_2 + R_3 < C7$ $C3 < R_1 + R_2 + R_3 < C12$

BRANCHED AT 3C POSITION $R_1 < C6$ $R_3 < C4$ $C1 < R_2 + R_3 < C7$ $C4 < R_1 + R_2 + R_3 < C10$

ALKOXYESTERCOMPOUNDS $R_4 < C5$ $R_5 < C3$ $C2 < R_4 + R_5 < C5$

KETOESTERCOMPOUNDS $R_4 < C5$ $R_5 < C3$ $C1 < R_4 + R_5 < C5$ $C2 < R_2 < C9$ $C1 \leq R \leq C5$ $\cap > X \geq 0$

BRANCHED AT 2C POSITION $R_3 < C4$ $\cap > X \geq 0$ $C1 < R_2 + R_3 < C7$ $C1 \leq R \leq C5$

BRANCHED AT 3C POSITION $R_3 < C4$ $\cap > X \geq 0$ $C1 < R_2 + R_3 < C7$ $C1 \leq R \leq C5$

METAL ALKOXYCARBOXYLATE $R_5 < C3$ $\cap > X \geq 0$ $C1 \leq R \leq C5$

METAL KETOCARBOXYLATE $R_5 < C3$ $\cap > X \geq 0$ $C1 \leq R \leq C5$

COMPOSITION AND PROCESS USING ESTER SOLVENTS FOR FABRICATING METAL OXIDE FILMS AND ELECTRONIC DEVICES INCLUDING THE SAME

BACKGROUND OF THE INVENTION

1. Field of the Invention

The present invention pertains to the field of liquid deposition techniques and, particularly, those using liquid precursor solutions to deposit metal oxide thin films for use in integrated circuits. The liquid solutions include an ester solvent and a metal carboxylate having a metal or metals in effective amounts for yielding a metal oxide of a desired stoichiometry upon drying and annealing of the liquid solution.

2. Statement of the Problem

Liquid precursor solutions are sometimes used in the integrated circuit industry to produce thin metal oxide films. These solutions typically include a mixture of metal-organic compounds, e.g., metal alkoxides, metal carboxylates or metal alkoxycarboxylates. The metal-organic compounds are mixed in relative proportions that yield a metal oxide of a desired stoichiometry upon drying and annealing of the liquid precursor solution. Metal acetates are often used for the superior film-forming qualities that derive from short-chain carboxylates. Metal acetates have long-term solubility problems and tend to precipitate from solution.

Use of liquid precursor solutions expedites the production process by avoiding the need for sputtering of the metals. By way of comparison, sputtering is a complicated trial and error process that requires a great degree of experimentation before a desired stoichiometry of metals can be formed in a solid solution after the anneal. On the other hand, liquid precursor solutions are associated with their own set of problems. Liquid precursor solutions must be prepared on-site at the manufacturing facility where they are needed because it is often impossible to prepare the liquid precursors well in advance of the time that they are used. This need arises because the liquid precursor solutions do not store well after they are made ready for use. These solutions can degrade with time due to ongoing chemical reactions.

Vest et al., *Synthesis of Metallo-organic Compounds for Mod Powders and Films*, Mat. Res. Soc. Symp. Proc. Vol. 60 (1986) teaches the production of metal carboxylates from a double decomposition reaction that proceeds from ammonium soap. Metal carboxylates are prepared to include neodecanoic and 2-ethylhexanoic ligands. Vest et al. alternatively teaches the production of metal carboxylates using a double decomposition reaction that proceeds from an amine soap. Additionally, a metathesis reaction reacts a metal alkoxide with a metal carboxylate. This metathesis reaction produces a metal alkoxycarboxylate and an alcohol by-product. Xylenes and water are used as the preferred solvents for these reactions. Vest et al. attempted to prepare these precursors in substantially pure form. Thus, the resultant metal carboxylates were never in a condition to be applied to an integrated circuit substrate.

Melnick et al., *Process Optimization and Characterization of Device Worthy Sol-gel Based PZT for Ferroelectric Memories, Ferroelectrics* (1990) discusses the use of sol-gels to make lead zirconium titanate films for use in integrated circuits. This paper teaches an acid-catalyzed condensation reaction that polymerizes the metal alkoxide precursor solution. A significant problem with the condensation reaction is that it continues with time. Thus, a sol-gel solution that has been made in the morning may not be usable in the afternoon. Additionally, the sol-gel solution may produce metal oxide films of different thicknesses as the morning progresses. This inconsistency ultimately leads to problems in the performance of the devices being produced. Thus, it is very unlikely that a sol-gel solution can be shipped from a chemical manufacturing plant to an integrated circuit manufacturing facility where the solution will be used without additional mixing at the manufacturing facility. This need for additional mixing can lead to stoichiometric errors that may affect an entire production run.

Sheriff, U.S. Pat. No. 5,034,550 teaches the formation of mixed heavy bimetallic alkoxide-carboxylate compositions. These compositions are formed by the reaction of a heavy metal tetra alkoxide and a heavy metal tricarboxylate. The solution is heated to eliminate a distillable, short, chain ester by-product (e.g., an acetate by-product). The alkoxycarboxylate reaction product is dissolved in toluene, butanol, heptane, methanol, and ethyl ether.

Watanabe et al., U.S. Pat. No. 5,434,102 teaches the reaction of a metal carboxylate with a metal alkoxide to form a metal alkoxycarboxylate. The metal alkoxycarboxylate is further reacted with heating in the presence of a metal carboxylate to form a compound having a metal-oxygen-metal bridge. The U.S. Pat. No. '102 lists suitable solvents including short and chain esters, such as butyl acetate, 2-methoxyethyl acetate, and 2-ethoxyethyl acetate.

In the U.S. Pat. No. '102 process and similar processes, acetates are used as co-solvents to enhance or improve the coverage of a given precursor application step.

The main portion of precursor solvent is most commonly xylenes. The addition of a polar (e.g., acetate) co-solvent is advised when the precursor metal compound is strongly electropositive. The most preferred polar co-solvents are 2-methoxyethanol and n-butyl acetate. The acetate solvent is a short-chain ester that is perceived to optimize solubilization of other solution ingredients while also permitting good step coverage. Longer chain esters are not in common use. Other useful solvents include xylenes and 2-methoxyethanol, which are undesirable from an environmental, regulatory and health standpoint.

A problem sometimes arises during the storage of precursor solutions such as those described in the U.S. Pat. No. 5,434,102. Metal carboxylate solutions in xylenes and n-butyl acetate tended to react with the n-butyl acetate co-solvent in a transesterification reaction. This reaction typically occurs between an alkaline earth metal 2-ethylhexanoate and the n-butyl acetate to produce an alkaline earth metal acetate, which precipitates from solution. This precipitation degrades the performance of the coating solutions by causing a reduction in molarity or a stoichiometric imbalance determined with respect to the desired metal oxide composition corresponding to the solution ingredients.

There exists a need for an alternative solvent that provides a liquid precursor solution having good substrate wetting characteristics, sufficient film strength to prevent cracking during the drying and anneal process, and good long-term storage capability when strongly electropositive metals are in solution.

SOLUTION TO THE PROBLEM

The present invention overcomes the problems that are outlined above by providing a precursor solution which does not react with short chain esters in solution to precipitate out strongly electropositive metals. The solution may be used to form high quality thin-film metal oxides on integrated circuit substrates. The solutions have an extremely long shelf life while providing consistent and superior film qualities. The presently claimed invention also overcomes the environmental problem of prior xylenes and 2-methoxyethanol solutions by avoiding use of these substances.

Liquid precursors of the presently-claimed invention include an ester solvent having a carboxylate portion with a carbon skeleton chain having a length ranging from five to ten carbon atoms. The precursors also include a metal carboxylate portion having at least one metal carboxylate in an effective amount for yielding an oxide of the metal upon annealing of the metal carboxylate portion.

The ester solvent itself is formed as the union of a carboxylate group and an alkane group. The carboxylate group may be a straight-chain carboxylate, but is more preferably a branched carboxylate having an alkane substituent branching from the second or third carbon of the carboxylate group. Examples of useful ester solvents include ethyl butylate, ethyl isobutylate, ethyl isovalerate, ethyl caproate, ethyl heptanoate, ethyl 2-ethylhexanoate, ethylcaprylate and ethylcaprate, methyl-3-methoxypropionate, ethyl-3-ethoxypropionate, and ethyl levulinate (4-oxopentanoicacidethylester). The metal carboxylate portion of the liquid precursor solution preferably has a normality in the ester solvent ranging from 0.1 to 0.4 moles per kilogram to facilitate use of the solution in making integrated circuits. The term "metal carboxylate portion" is hereby defined to include both metal carboxylates and metal alkoxycarboxylates.

The liquid precursor solution is preferably free of short-chain esters, such as acetates, and is more preferably free of esters having a carboxylate ligand with a carbon chain of less than four carbons.

The aforementioned ester solvent-based solutions are especially useful when the metal carboxylate portion includes a strongly electropositive metal, such as an alkaline earth metal. Ester solvent based solutions are especially advantageous when used to make layered superlattice materials, such as the strontium bismuth tantalate materials discussed in U.S. Pat. No. 5,434,102, which is hereby incorporated by reference to the same extent as though fully disclosed herein. The ester solvent based solutions are also especially useful in making $ABO_3$ perovskites, such as barium strontium titanate. Use of the ester solvent-based solutions provides a high yield of electronically competent thin films, and these films have exceptionally high dielectric constants. The ferroelectric materials produced with these solutions also have very high polarizabilities.

These precursor solutions are applied to an integrated circuit substrate, dried, and annealed in a oxygen-containing environment to produce a thin-film metal oxide.

DETAILED DESCRIPTION OF THE PREFERRED EMBODIMENT

FIGS. 1–5 depict preferred ester solvents for use in the present invention. These esters are mixed as solvents with metal carboxylates to provide liquid solutions used in making integrated circuits.

Figure 1:
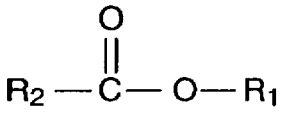
FIG. 1 depicts a molecular formula of an unbranched ester for use as a solvent in metal carboxylate or metal alkoxycarboxylate solutions according to the present invention.

FIG. 1 depicts an unbranched ester solvent (i.e., one having an unbranched carboxylate group), wherein C is carbon, O is oxygen, $R_1$ is an alkyl group having from one to five carbons, $R_2$ is an alkyl group having from three to eight carbons, and the total number of carbon atoms in $R_1$ and $R_2$ is greater than four and less than twelve. Exemplary esters described by FIG. 1 include ethyl butylate, ethyl caproate, ethyl heptanoate, ethyl caprylate, and ethyl caprate.

Figure 2:
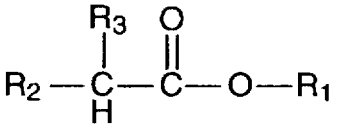
FIG. 2 depicts a molecular formula of a α-branched carbonyl ester for use as a solvent in metal carboxylate or metal alkoxycarboxylate solutions according to the present invention.

FIG. 2 depicts an ester solvent having a α-branched carbonyl group (i.e., one having an alkane branch at the second carbon of the carboxylate group), wherein $R_1$ and $R_2$ are defined above; $R_3$ is an alkyl group having from one to three carbons; $R_2$ and $R_3$ together have more than one carbon and less than seven carbons; and $R_1$, $R_2$, and $R_3$ together have more than three carbons and less than twelve carbon atoms. Exemplary esters according to FIG. 2 include ethyl isobutylate and ethyl 2-ethylhexanoate.

Figure 3:
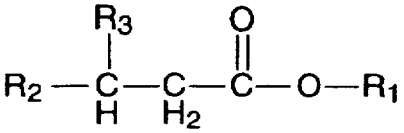
FIG. 3 depicts a molecular formula of a β-branched carbonyl ester for use as a solvent in metal carboxylate or metal alkoxycarboxylate solutions according to the present invention.

FIG. 3 depicts an ester having a β-branched carbonyl group (i.e., one having an alkane branch at the third carbon of the carboxylate group), wherein $R_1$, $R_2$, and $R_3$ are defined above, $R_2$ and $R_3$together have more than one carbon and less than seven carbons; and $R_1$, $R_2$, and $R_3$ together have more than four carbons and less than ten carbon atoms. An exemplary ester according to FIG. 3 includes ethyl isovalerate.

Figure 4:
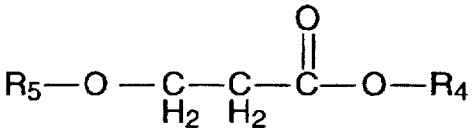
FIG. 4 depicts a molecular formula of an alkoxyester for use as a solvent in metal carboxylate or metal alkoxycarboxylate solutions according to the present invention.

FIG. 4 depicts an alkoxyester compound wherein $R_4$ is an alkyl group having from one to four carbons, $R_5$ is an alkyl group having from one to three carbons, and $R_4$ and $R_5$ together have from three to four carbons atoms. Exemplary esters according to FIG. 4 include methyl-3-methoxypropionate and ethyl-3-ethoxypropionate.

Figure 5:
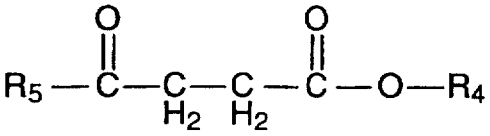
FIG. 5 depicts a molecular formula of a ketoester for use as a solvent in metal carboxylate or metal alkoxycarboxylate solutions according to the present invention.

FIG. 5 depicts a ketoester compound wherein R4 and R5 are defined above, and $R_4$ and $R_5$ together have from three to four carbons atoms. An exemplary ester compound according to FIG. 5 is ethyl levulinate (4-oxopentanoicacidethylester).

Figure 6:
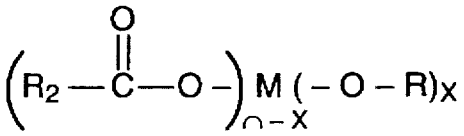
FIG. 6 depicts a molecular formula of an unbranched metal carboxylate for use in combination with ester solvents according to the present invention.

FIGS. 6–10 depict preferred metal carboxylates for use in solution with the ester compounds of FIGS. 1–5. FIG. 6 depicts an unbranched metal carboxylate wherein $R_2$ is defined above; R is an aliphatic carbon chain having from one to five carbon atoms; M is a metal having valence requirements of n; and n and x are integers such $n>x\geqq 0$. It is especially preferred to use the metal carboxylate of FIG. 6 with the primary ester of FIG. 1.

Figure 7:
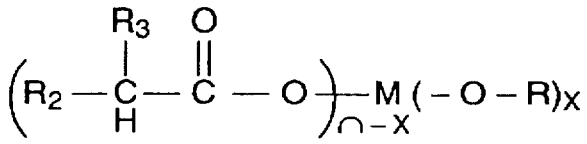
FIG. 7 depicts a molecular formula of a α-branched carbonyl metal carboxylate for use in combination with ester solvents according to the present invention.

FIG. 7 depicts a α-branched metal carboxylate (branched at the second carbon of the carbonyl group) wherein R, $R_2$, $R_3$, n, x, and M are defined above, and $R_2$ and $R_3$ together have from two to six carbon atoms. It is especially preferred to use the metal carboxylate of FIG. 7 with the secondary ester of FIG. 2.

Figure 8:
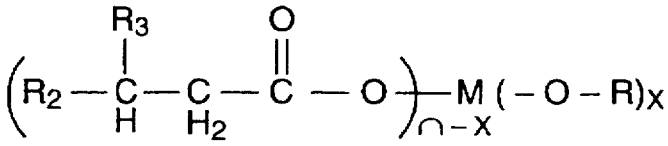
FIG. 8 depicts a molecular formula of a β-branched carbonyl metal carboxylate for use in combination with ester solvents according to the present invention.

FIG. 8 depicts a β-branched metal carboxylate (branched at the third carbon of the carbonyl group) wherein R, $R_2$, $R_3$, n, x, and M are defined above, and $R_2$ and $R_3$ together have from two to six carbon atoms. It is especially preferred to use the metal carboxylate of FIG. 8 with the tertiary ester of FIG. 3.

Figure 9:
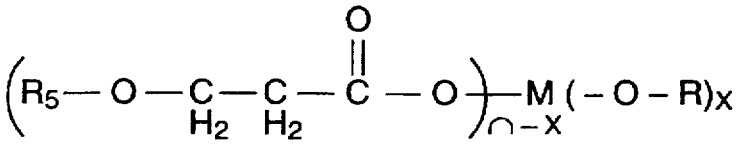
FIG. 9 depicts a molecular formula of a metal alkoxycarboxylate for use in combination with ester solvents according to the present invention.

FIG. 9 depicts a metal alkoxycarboxylate wherein R, $R_5$, n, x, and M are defined above. It is especially preferred to use the metal carboxylate of FIG. 9 with the alkoxyester compound of FIG. 4.

Figure 10:
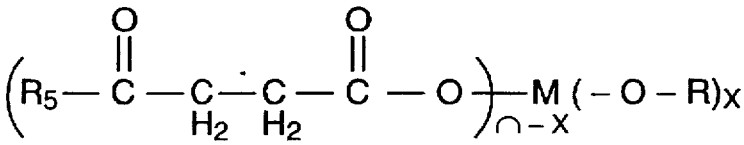
FIG. 10 depicts a molecular formula of a metal ketocarboxylate for use in combination with ester solvents according to the present invention.

FIG. 10 depicts a metal ketocarboxylate wherein R, $R_5$, n, x, and M are defined above. It is especially preferred to use the metal carboxylate of FIG. 10 with the alkoxyester compound of FIG. 5.

The above discussion referencing FIGS. 1–10 mentions substituents or groups $R_1$ through $R_5$. These groups may be any aliphatic hydrocarbon, but are most preferably alkyl groups.

In the past, acetates have been used as a polar co-solvent in a xylenes based system. The problem with using an acetate co-solvent is that solution kinetics requires the dissolution and reformation of the metal alkoxycarboxylate precursor. Similarly, the acetate is an ester that divides into a carboxylate portion and an alkyl portion. For example, in the case of n-butyl acetate, the carboxylate portion derives from acetic acid. The alkane portion derives from n-butane. In FIGS. 1—3, the alkane portion is $R_1$, and the carboxylate portion is everything to the left of $R_1$.

A specific problem that the present invention avoids is that solution equilibrium requires the carboxylate ligand of the metal alkoxycarboxylate or metal carboxylate precursor (see equations (4)–(7) below) to dissociate from the metal. Similarly, when an acetate ester solvent is in solution, the acetate ligand dissociates from its corresponding alkane. The acetate ligand then combines with the metal and the carboxylate ligand combines with the alkane, i.e., a transesterification reaction occurs. The resultant metal acetate is much less soluble in a xylenes system than is the metal carboxylate or metal alkoxycarboxylate and, consequently, precipitates from solution.

The present invention avoids the problem with precipitation induced by the transesterification reaction because transesterification with the esters shown in FIGS. 1–5 produces a medium-chain metal carboxylate that does not precipitate from the ester solvent. The longer carboxylate chain keeps the metal organic compound in solution. At the same time, thin films produced by drying and annealing the solution do not bubble, crack or peel, i.e., the solutions retain excellent film qualities for use in integrated circuit applications.

Figure 11:
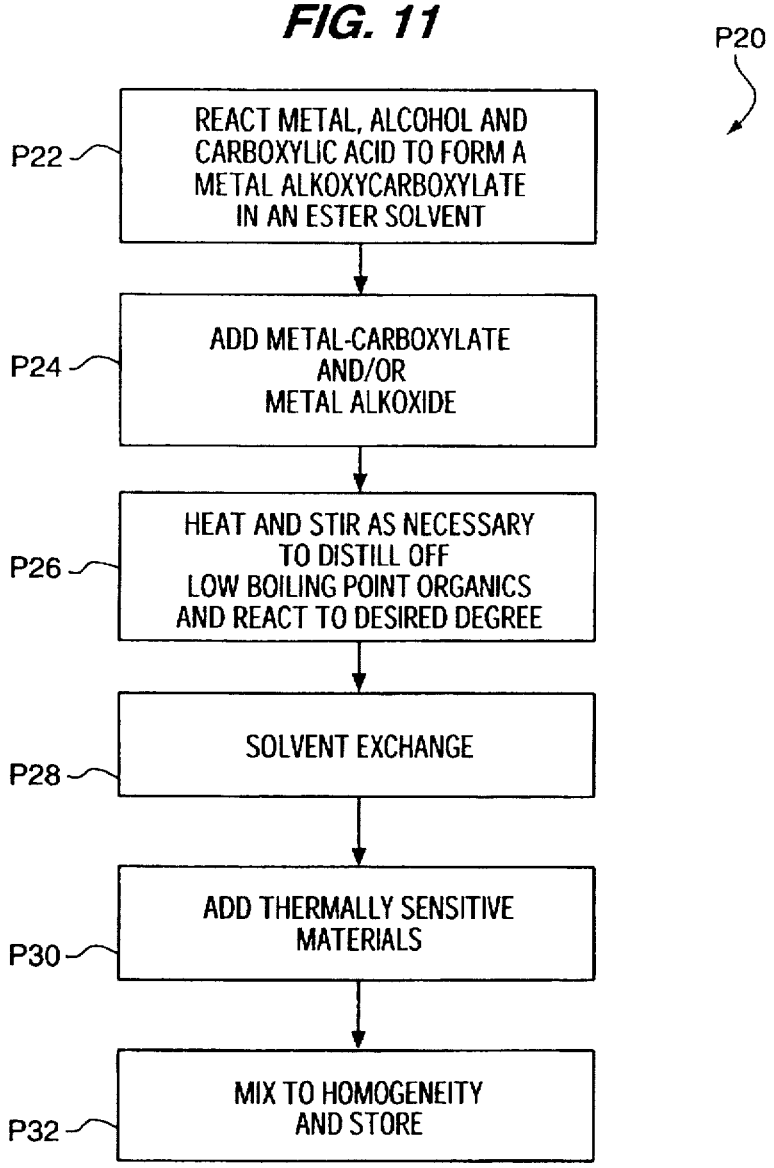
FIG. 11 depicts a schematic process diagram for use in making the ester-based solutions of the present invention.

Another aspect of the present invention is the use of derivatives or homologues of the compounds shown in FIGS. 6–10 in combination with the ester solvents of FIGS. 1–5. Along these lines, FIG. 11 depicts a schematic process diagram for making a preferred solution including an ester solvent according to one of FIGS. 1–5 in combination with a derivative of the metal carboxylates shown in FIGS. 6 and 9. These solutions may include different metal carboxylates having a plurality of metals in proportions that yield a metal oxide having a desired stoichiometry upon drying and annealing of the liquid solution.

FIG. 11 depicts a process P20. In step P22, a metal, carboxylic acid, and alcohol are combined with one of the ester solvents shown in FIGS. 1–5. The reactions shown below in equations (1)–(3) proceed to form metal alkoxides, metal carboxylates, and metal alkoxycarboxylates, as follows:

(1) alkoxides—$M^{+n}$+n R'—OH→M(—O—R')$_n$+n/2 $H_2$ (2) carboxylates—$M^{+n}$+n (R'—COOH)→M(—OOC—R')$_n$+n/2 $H_2$ (3) alkoxycarboxylates—M(—O—R")$_n$+b R'—COOH+heat→(R"—O—)$_{n-b}$M(—OOC—R')$_b$+b HOR', where M is a metal cation having a charge of n; b is a molar equivalent ranging from 0 to n; R" is preferably an alkyl group having from 4 to 15 carbon atoms and R' is preferably an alkyl group having from 3 to 9 carbon atoms. The reaction of equation (1) is exothermic, and normally proceeds at the fastest rate to warm the solution. The reaction shown in equation (2) proceeds to a lesser degree.

Heating of the solution, as shown in equation (3), is much preferred because it yields a metal, alkoxycarboxylate and because the heating is used to distill volatile organics and water from the solution. Distillation-heating is most preferred because any water left in solution tends to react with the metal alkoxide of equation (1) and impair the desired reaction process. Additionally, it is desirable to remove volatile organics, which dry relatively quickly and sometimes cause cracking or peeling of the thin films during the integrated circuit manufacturing process. This heating preferably occurs for eight to twenty four hours in the temperature range from 100° C. to 200° C. and, more preferably, in the range of from 115° to 140° C. Heating can occur at higher temperatures, but these are increasingly associated with thermal degradation of the reagents and products.

Step P24 includes the addition of a metal alkoxide or metal carboxylate to the precursor from step P24. In step P26, the combined solution is preferably heated with distillation of volatile fractions to eliminate water and low boiling point organics as before. The addition of an alkoxide together with heating produces endothermic reactions according to formulae (4) or (5), as shown below:

(4) (R'—COO—)$_x$M(—O—R")$_a$+M'(—O—R'")$_b$→(R'—COO—)$_x$M(—O—M'—(O—R'")$_{b-1}$)$_a$+a R"—O—R'"

(5) (R'—COO—)$_x$M(—O—R")$_a$+x M'(—O—R'")$_b$→(R"—O—)$_a$M(—O—M'(—O—R'")$_{b-1}$)$_x$+x R'—COO—R' where M and M' are metals; R' and R" are defined above; R'" is an alkyl group preferably having from one to sixteen carbons; and a, b, and x are integers denoting molar equivalents that satisfy the respective valence states of M and M'.

Generally, the reaction of equation (4) occurs more quickly than the others. Thus, ethers having low boiling points are generally formed. These ethers boil out of the pre-precursor to leave a final product having a reduced organic content and the metal-oxygen-metal bonds of the final desired metal oxide already partially formed. If the heating is sufficient, some of the reaction (5) will also occur, creating metal-oxygen-metal bonds and esters. The esters generally have higher boiling points and remain in solution. These esters slow down the drying process after the final precursor is applied to a substrate, which tends to reduce cracking and defects. Thus, in either case, metal-oxygen-metal bonds are formed and the final precursor performance is improved.

The ester by-product of equation (5) is only present in a very minor percentage (i.e., less than about five to twenty percent of the solution weight), and seldom exceeds ten percent. According to the present invention, the long-chain ester content of the precursor solution is enhanced by the addition of a greater amount of ester solvent from a source outside the reaction shown in FIG. 5. These reaction can proceed in the solution after the addition of ester solvent.

Step P24 includes the addition of a metal-carboxylate to the metal-alkoxycarboxylate with heating of the mixture, the following reaction occurs:

(6) $(R'—COO—)_xM(—O—R'')_a+x\ M'(—OO—CR''')_b \rightarrow (R''—O—)_aM(—O—M'(—OOC—R'''')_{b-1})_x+x\ R'—COOOC—R''$ where R'—COOOC—R" is an acid anhydride, and the terms are as defined above. This reaction requires considerably more heat than do the reactions (4) and (5) above, and proceeds at a much slower rate. The reaction products of equations (4)–(6) can be heated with excess carboxylic acid to further substitute carboxylate ligands for alkoxide ligands, thereby reducing the hydrolyzing ability of the carboxylated products and increasing precursor shelf life.

In addition to the above reactions which produce metal-alkoxycarboxylates, reactions occur such as:

(7) $M(—OR')_a+a\ HO_2C_8H_{15}+heat \rightarrow M(—O_2C_8H_{15})_a+a\ HOR'$, where the terms are as defined above. This reaction, with heating in the presence of excess carboxylic acid, substitutes the alkoxide part of the intermediate metal-alkoxycarboxylate to form a substantially full carboxylate; however, a complete substitution of the alkoxides by the carboxylates does not occur with the parameters as disclosed herein. Full substitution of the carboxylates requires significantly more heating, and even then may not readily occur.

The reactions shown in equations (1)–(7) preferably occur in one of the ester solvents shown in FIGS. 1–5; however, other solvents can also be used. For example, a cosolvent, e.g., xylenes (b.p. 137–138) or octane (b.p. 125) can be used to facilitate one of the reactions shown in equations (1)–(7). It then becomes desirable to remove the cosolvent from solution, but it is necessary to specially select the solvents to provide a cosolvent having a lower boiling point than the ester solvent selected from FIGS. 1–5. The cosolvent is simply distilled from solution to leave the ester behind.

Polar or apolar cosolvents may also be added to better solubilize the metal carboxylates or provide better substrate wetting ability. Suitable cosolvents include xylenes, 2-methoxyethanol, n-dimethylformamide, methyl isobutylketone, methyl isoamylketone, isoamyl alcohol, cyclohexanone, 2-ethoxyethanol, 2-methoxyethyl ether, methyl butyl ketone, hexyl alcohol, 2-pentanol, nitroethane, pyrimidine, 1, 3, 5 trioxane, ethyl lactate, n-butanol, n-pentanol, 3-pentanol, toluene, ethylbenzene, octane, nonane, and decane. The solution is preferably kept free of short chain esters, such as acetates, butyrates, and propionates.

The use of a common or standard solvent shared by a variety of precursor solutions respectively having equivalent molarities different metal oxide empirical formulae offers similar fluid parameters, such as viscosity and adhesion tension. These uniform fluid parameters provide predictability of performance, i.e., different solutions can be used in substantially the same way to make similar quality films of different compositions corresponding to the metal contents of the respective solutions. For example, a 0.2M barium strontium titanate precursor solution could be used in substantially the same way as a 0.2M lead zirconium titanate precursor solution.

At the conclusion of step P28, the standard ester solvent is preferably added in an amount that is appropriate to adjust the intermediate precursor to a desired molarity corresponding to a empirical metal oxide formula. This molarity preferably ranges from about 0.100M to about 0.400M determined as moles of the stoichiometric empirical formula for the desired metal oxide, and is most preferably about 0.200M. After addition of the ester solvent, the solution is again heated to a temperature that is sufficient to distill away any non-standard solvents and leave a solution having the desired molarity.

Step P30 includes adding thermally sensitive materials to the solution derived from step P28. Certain metal-organic compounds are thermally unstable, most notably those including $Bi^{3+}$, is the most preferred superlattice-generator element, and the bismuth pre-precursor is most preferably bismuth tri-2-ethylhexanoate. The addition of bismuth pre-precursors subsequent to the heating of step P30 is preferred due to the relative instability of these pre-precursors, i.e., substantial heating could disrupt coordinate bonds with potential deleterious effects upon the ability of the solution to yield superior thin-film metal oxides. It should be understood that step P30 is optional in the sense that bismuth pre-precursors can often be added in any of steps P22, P24, P26 and P28 without problems.

Other special problems exist with regard to the potential for bismuth volatilization during heating of the precursor solution and, especially, during high temperature annealing of the dried precursor residue to form a layered superlattice material of the desired stoichiometric proportions. Accordingly, in step P30, it is preferred to add from about 5% to about 15% excess bismuth for purposes of compensating the precursor solution for anticipated bismuth losses. At annealing temperatures ranging from about 600° C. to about 850° C. for a period of about one hour, this excess bismuth moiety in the precursor solution will typically range from 5% to 9% of the proportional amount that is required for a stoichiometrically balanced product.

Step P32 includes mixing the solution to substantial homogeneity. The solution is stored indefinitely until it is required for use. Accordingly, large production runs may be made for storage with small aliquots being taken for use as needed. Solutions made according to this procedure typically have a storage life exceeding one year or more. Thus, the solutions may be stored until they are needed, e.g., for one month, three months, six months, or more than one year.

Equations (1)–(7) may be applied to any metal as M and M'. Preferred metals for use in equations (1)–(7) include those in Groups 2–8, 10, 11, 14, and 15 of the periodic table (new IUPAC notation), as well as Lanthanide metals. Particularly preferred metals include tantalum, calcium, bismuth, lead, yttrium, scandium, lanthanum, cerium, neodymium, samarium, europeum, gadolinium, terbium, dysprosium, antimony, chromium, thallium, hafnium, tungsten, niobium, vanadium, zirconium, manganese, iron, cobalt, nickel, magnesium, molybdenum, strontium, barium, titanium, and zinc.

Figure 12:
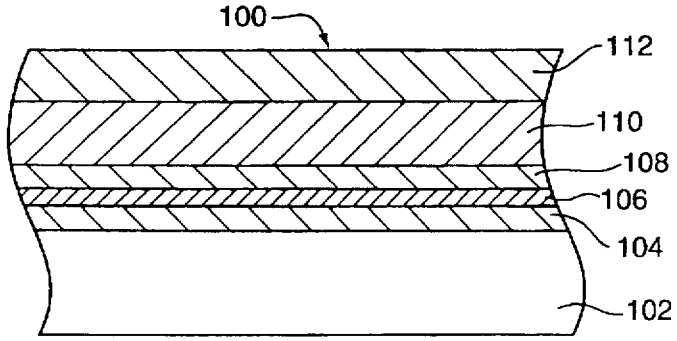
FIG. 12 depicts a capacitor device that is made using solutions according to the present invention.

FIG. 12 depicts a thin film ferroelectric capacitor 100 that is made using solutions according to the present invention. Capacitor 100 includes wafer 102, which may be made of any integrated circuit wafer material, such as gallium arsenide, sapphire, and quartz. Wafer 102 is preferably made of n or p-doped silicon or, more preferably, n-doped silicon. Conventional silicon technology p-dopants include boron, aluminum, gallium, and indium. Conventional n-dopants include phosphorous, arsenic, and antimony. This discussion will concentrate on silicon technology devices, but those skilled in the art will understand its applicability to other types of substrates.

An isolation layer 104 is preferably formed over wafer 102. This isolation layer is preferably formed of silicon dioxide, which may be a thermally grown oxide or one of the commercially available varieties of spin-on glass.

A titanium adhesion layer 106 is sputtered atop isolation layer 104 to a thickness of about 200 Å to 400 Å. A platinum electrode 108 is sputtered atop adhesion layer 106 to a thickness of about 2000 Å. A metal oxide layer 110 is deposited on electrode 108, and a top electrode 112 is sputtered atop layer 112.

As used herein, the term 'substrate' means all of the underlying layers that support other layers. Thus, wafer 102 is a substrate for oxide layer 104 which, in combination with wafer 102, is a substrate for adhesion layer 106.

Metal oxide layer 112 is deposited using solutions according to the present invention. These solutions are specially mixed to provide a desired stoichiometry in the final metal oxide. The metals react with atmospheric oxygen when the solutions are annealed to yield a crystalline metal oxide having the desired stoichiometry. Preferred metal oxides include perovskites having a well known ABO3 structure, wherein A and B represent metal atoms having the correct size and valence for occupation of corresponding A-sites and B-sites in the perovskite lattice. Perovskites are preferred for their extremely high dielectric constants and long useful life. Particularly preferred perovskites include barium strontium titanate ("BST;" especially $(Ba_{0.7}Sr_{0.3})TiO_3$) and lead zirconium titanate ("PZT"). Some mixtures of these materials are ferrorelectric, in addition to having high dielectric constants. $(Ba_{0.7}Sr_{0.3})TiO_3$ is not ferroelectric in the typical range of operating temperatures for integrated circuit devices, and has a relatively high dielectric constant when compared to other BST materials in these temperature ranges.

Layered superlattice materials are particularly preferred for layer 106 when it is desired to make layer 110 a ferroelectric. The term "layered superlattice material" is used herein because no well-defined accepted term exists in the art to describe these type of materials. Layered superlattice materials at least include all three of the Smolenskii-type ferroelectric layered superlattice materials, namely, those having the respective average empirical formulae:

(8) $A_{m-1}S_2B_mO_{3m+3}$;

(9) $A_{m+1}B_mO_{3m+1}$; and

(10) $A_mB_mO_{3m+2}$, wherein A is an A-site metal in the perovskite-like superlattice, B is a B-site metal in the perovskite-like superlattice, S is a trivalent superlattice-generator metal such as bismuth or thallium, and m is a number sufficient to balance the overall formula charge. Where m is a fractional number in the overall formula, the formula typically provides for a plurality of different or mixed perovskite-like layers each having a different integer value. The A-site metals and B-site metals may include mixtures of cations having similar ionic radii.

The superlattice-generator layers, S, include oxides of bismuth (III), and may also include other similarly sized trivalent metal cations such as thallium (III). Bismuth also functions as an A-site metal in the perovskite-like lattice if it is present in excess of the stoichiometrically required amount for generating the layered superlattice material according to Formula (I). The most preferred layered superlattice materials include strontium bismuth tantalate, strontium bismuth niobate, and strontium bismuth niobium tantalate. Additionally, it can be advantageous to provide these materials with a mixture B-site elements including vanadium and tungsten. Capacitor 100 is patterned into an integrated circuit by conventional photolithography techniques.

Figure 13:
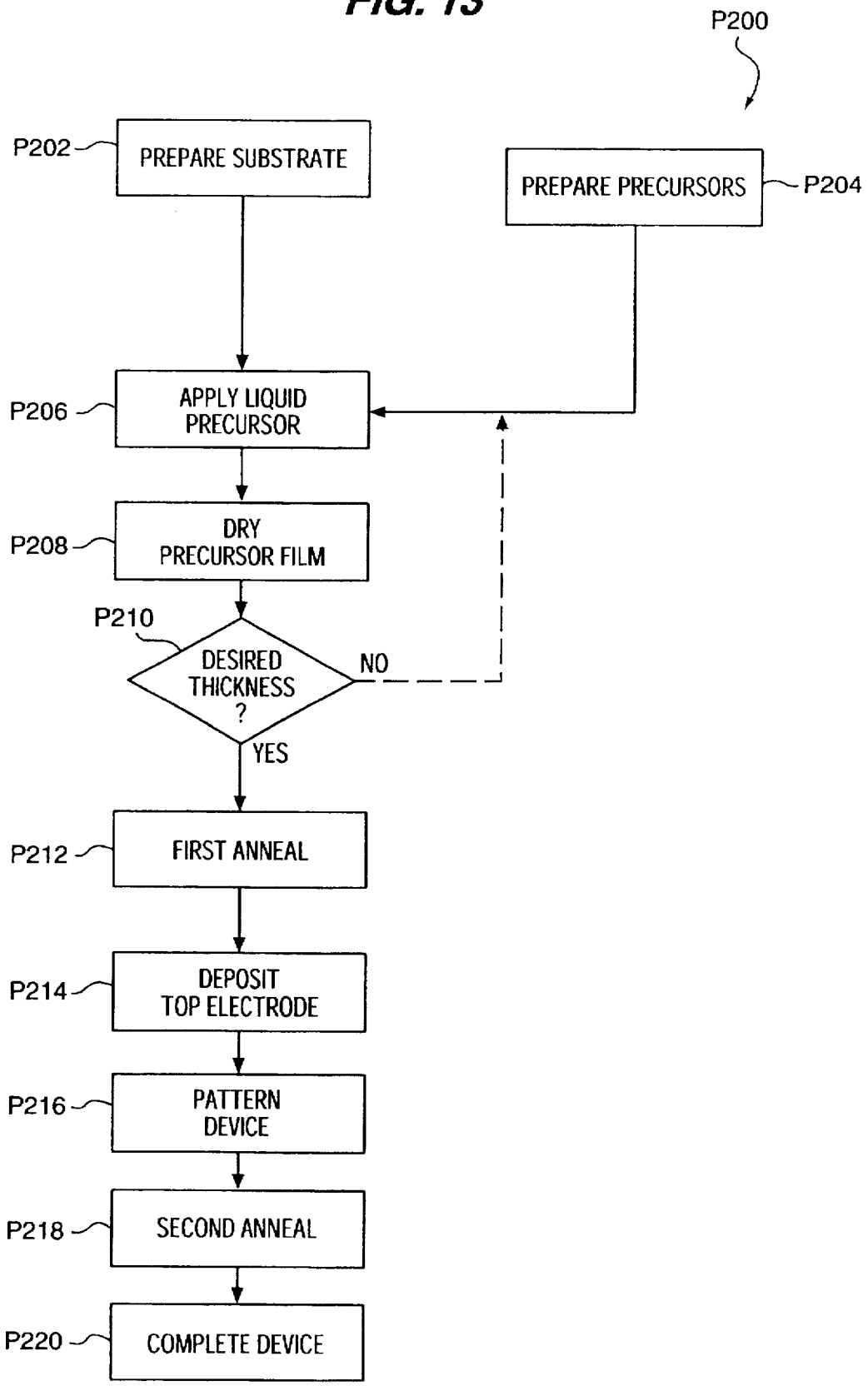
FIG. 13 depicts a schematic process diagram showing use of the ester-based solutions to make an integrated circuit.

FIG. 13 depicts a flow chart of a process P200 for making capacitor 100 (see FIG. 12). In step P202, a silicon wafer is prepared as wafer 102 (see FIG. 12) for the receipt of additional layers. A conventional water or solvent wash suffices to clean wafer 102. Wafer 102 preferably contains n-doped or p-doped silicon, and can be doped as required according to conventional protocols known to those skilled in the art. Step P204 includes the preparation of a liquid precursor solution having a plurality of metal moieties in effective amounts for yielding a desired metal oxide, e.g., layered superlattice material or perovskite, upon thermal treatment of the solution. The precursors more preferably include at least three metals as a mixture of different metal organic compounds. The performance of metal oxide layer 110 (see FIG. 12) in large part derives from the type of precursor solution selected, the purity of the reagents selected, and the subsequent processing of the solution. Additional details pertaining to the production of these precursors are provided above in the discussion of FIG. 11. Adhesion layer 104 and bottom electrode 106 are preferably sputtered into position by conventional vacuum sputtering means.

In step P206, the liquid solution from step P204 is applied to the substrate from step P204. The application is preferably conducted by dropping the liquid precursor solution at ambient temperature and pressure onto the uppermost surface of substrate 102 then spinning the wafer at from about 1,500 RPM to 2,000 RPM for about 30 seconds to remove any excess solution and leave a thin-film liquid residue. The most preferred spin velocity is 1,500 RPM. Alternatively, the liquid precursor may be applied by a misted deposition technique.

Step P208 includes drying the liquid precursor film from step P206 on a hot plate at a temperature of from about 200° C. to 500° C. in a dry air atmosphere. The drying time and temperature should be sufficient to remove or calcine substantially all of the organic materials from the liquid thin film and leave a dried metal oxide residue. The drying time preferably ranges from about one minute to about thirty minutes. For single-stage drying, a 400° C. drying temperature over a duration of about two to ten minutes in air is most preferred. It is more preferred, however, to dry the liquid film in stepped intervals. For example, the film can be dried for five minutes at 260° C. and for five minutes at 400° C. Additionally, it is preferred to conclude the drying cycle with a brief heating interval at a temperature exceeding 700° C., e.g., using a tungsten-nickel lamp to heat the substrate to 725° C. for thirty seconds. This rapid thermal heating and cooling cycle promotes nucleation and small crystal grain sizes, and also facilitates removal of the remaining organic moieties in the dried precursor film. The drying step P208 is essential in obtaining predictable or repeatable electronic properties in the final metal oxide crystal compositions.

In step P210, if the dried film from step P208 is not of the desired thickness, then steps P206 and P208 are repeated, as needed, until the desired thickness is attained. A thickness of about 1,800 Å to 2,000 Å typically requires two coats of a 0.130M to 0.022M precursor solution under the parameters disclosed herein.

In step P212, the dried precursor residue from step P208 is annealed to form metal oxide layer 110 (see FIG. 12). This annealing step is referred to as the first anneal to distinguish it from other annealing steps; however, other anneal steps can occur prior to this "first anneal." For example, step P202 may include numerous annealing steps. In step P212, the wafer 102 including the dried precursor residue from step P208 is heated in a diffusion furnace under an oxygen atmosphere to a temperature ranging from 450° C. to 1,000° C. for a time ranging from thirty minutes to two hours. Step P212 is more preferably conducted at a temperature ranging from 600° C. to 800° C., with the most preferred anneal temperature being about 600° C. for eighty minutes. The first anneal of step P212 preferably occurs in a push/pull process including five minutes for the "push" into the furnace and five minutes for the "pull" out of the furnace. The indicated anneal times include the time that is used to create thermal ramps into and out of the furnace. In a commercial manufacturing process, it is advantageous to provide careful control of all annealing temperatures and times for purposes of providing consistent and reproducible results.

In step P214, top electrode 40 is preferably deposited by sputtering platinum atop ferroelectric layered superlattice layer 28.

The device is then patterned in step P216 by a conventional photolithography technique, e.g., one including the application of a photoresist followed by ion etching lithography. This patterning preferably occurs before the second anneal of step P218 so that the fourth anneal removes patterning stresses from the resultant integrated circuit (e.g., one including capacitor 100 as shown in FIG. 12) and correct any defects that are created by the patterning procedure. The second anneal of step P218 is preferably conducted in like manner with the first anneal of step P212.

In step P220, the device is completed and evaluated. The completion may entail the deposition of additional layers, ion etching of contact holes, and other procedures, as will be understood by those skilled in the art. For example, these procedures could include the formation of a transistor or ferroelectric DRAM circuit incorporating capacitor 100.

The following examples set forth preferred materials and methods for practicing the present invention.

EXAMPLE 1

Preparation of a Strontium Bismuth Niobium Tantalate Precursor Solution

The following ingredients were purchased from the indicated suppliers and weighed in the proportions shown in Table 1.

TABLE 1

| Material | Weight | Formula Weight | milimoles | Supplier |
|---|---|---|---|---|
| Tantalum (V) butoxide in hexane | 12.94 g | Ta 33.6% | 24.00 | Vinipin |
| Niobium (V) butoxide in hexane | 7.38 g | Nb 20.2% | 16.00 | Vinipin |
| 2-ethylhexanoic acid | 30.34 g | 144.21 | 210.4 | Aldrich |
| Ethyl isovalerate | 40 ml (34.6 g) | 130.19 | 265.8 | Aldrich |
| Strontium metal | 1.752 g | 87.62 | 20.00 | Aldrich |
| 2-ethylhexanoic acid | 6.1 g | 144.21 | 42.3 | Aldrich |
| Bismuth 2-ethylhexanoate in solvent | 42.78 g | Bi 21.3% | 43.6 | Vinipin |
| Ethyl isovalerate | 11.7 g | 130.19 | 89.9 | Aldrich |

The tantalum (V) butoxide, niobium (V) butoxide, and 30.34 g portion of 2-ethylhexanoic acid were poured with 40 ml of ethyl isovalerate together into an Erlenmeyer flask equipped with a reflex condenser. The mixture was heated on a hot plate at 160° C. for 18 hours with constant stirring. The solution was removed from the hot plate and cooled to below 100° C. The strontium metal was added to the hot solution together with 6.1 g of 2-ethylhexanoic acid. The mixture in the Erlenmeyer flask was again heated at 160° C. on a hot plate and permitted to react for half-an-hour until the strontium metal was completely dissolved. The solution was refluxed for an additional three hours after dissolution of the strontium metal. A distillation head and a Claisen condenser were then attached to the flask and about 50 ml of solvent was distilled off at a distillation temperature ranging from 70°–115° C. The solution stood to room temperature. The bismuth 2-ethylhexanoate was added to the solution. Concentration of the solution was adjusted to 0.2 m/kg by adding ethyl isovalerate and the total weight of the solution was 100 g.

The resultant solution corresponded to a desired metal oxide having the Smolenskii formula (8) above, i.e., $A_{m-1}S_2B_mO_{3m+3}$, wherein m equals 2 and anticipated bismuth volatilization losses in the anneal approximate ten percent. The solution is designed to yield a metal oxide having the stoichiometry $SrBi_2(Nb_{0.8}Ta_{1.2})O_9$, after volatilization losses.

EXAMPLE 2

Preparation of a 0.15 mol/kg $SrBi_{2.18}Nb_{0.8}Ta_{1.2}O_9$ Solution in Methyl-3-methoxypropionate

TABLE 2

| Material | Weight | Formula Weight | Milimoles | Supplier |
|---|---|---|---|---|
| Tantalum (V) ethoxide | 9.75 g | 406.25 | 24.0 | Strem |
| Niobium (V) ethoxide | 5.09 g | 318.21 | 16.00 | Strem |
| 2-ethylhexanoic acid | 30.34 g | 144.21 | 210.4 | Aldrich |
| Methyl-3-methoxypropionate | 40 ml (40.4 g) | 120.15 | 336.2 | Aldrich |
| Strontium metal | 1.752 g | 87.62 | 20.00 | Aldrich |
| 2-ethylhexanoic acid | 6.1 g | 144.21 | 42.3 | Aldrich |
| Bismuth 2-ethylhexanoate in hexane | 41.41 g | Bi 22% | 43.60 | Chemat Tec. |
| Methyl-3-methoxypropionate | | | Adjust to 0.15 mol/kg | Aldrich |

The tantalum (V) ethoxide (9.75 g, 24.00 mmol), niobium (V) ethoxide (5.09 g, 16.00 mmol) and 2-ethylhexanoicacid (30.34 g, 210.4 mmol) and methyl-3-methoxypropionate (40 ml) were measured into an Erlenmeyer flask equipped with a reflux condenser. The mixture was heated on a hot plate at 130° C. for 18 hours with constant magnetic stirring, removed from the hot plate, and cooled to 100° C. Strontium metal (1.752 g), 20.00 mmol) and 2-ethylhexanoic acid (6.1 g, 42.3 mmol) were measured into the hot mixture, which was then returned to the hot plate for heating at 140° C. for one-half hour until the strontium metal was completely dissolved. The solution was refluxed for an additional three hours after which the flask was removed from the hot plate. About 50 ml of solvent was evaporated under vacuum in the temperature range of from 50°–120° C. The remaining solution was stood to room temperature. Bismuth 2-ethylhexanoate (Bi22% in hexane, 41.41 g, 43.6 mol) was added into the solution, and the solution concentration was adjusted to 0.15 mol/Kg by adding methyl-3-methoxypropionate. The total weight of the final solution was 133.3 g. The solution was designed to yield $SrBi_2Nb_{0.8}Ta_{1.2}O_9$ accounting for a ten percent bismuth volatilization loss in the anneal.

EXAMPLE 3

Preparation of a 0.15 mol/kg $SrBi_{2.18}Nb_{0.7}Ta_{1.3}O_9$ Solution in Ethyl Caprylate and Ethyl Butylate

TABLE 3

| Material | Weight | Formula Weight | milimoles | Supplier |
|---|---|---|---|---|
| Tantalum (V) ethoxide | 10.56 g | 406.25 | 26.00 | Strem |
| Niobium (v) ethoxide | 4.45 g | 318.21 | 14.00 | Strem |
| 2-ethylhexanoicacid | 30.34 g | 144.21 | 210.4 | Aldrich |
| n-octane | 40 ml (28.1 g) | 111.21 | 252.7 | Aldrich |
| Ethyl caprylate | 20 ml (17.6 g) | 172.27 | 101.9 | Aldrich |
| Strontium metal | 1.752 g | 87.62 | 20.00 | Aldrich |
| 2-ethylhexanoicacid 19 | 6.1 g | 144.21 | 42.30 | Aldrich |
| Bismuth-2-ethylhexanoate in hexane | 41.41 g | Bi 22% | 43.60 | Chemat Tec. |
| Ethyl butylate | | 116.16 | adjust to 0.15 mol/kg | Aldrich |

The Tantalum (V) ethoxide (10.56 g, 26.00 mmol), niobium (V) ethoxide (4.45 g, 14.00 mmol) and 2-ethylhexanoicacid (30.34 g, 210.4 mmol) n-octane (40 ml) and ethyl caprylate (20 ml) were measured into an Erlenmeyer flask equipped with a reflux condenser. The mixture was heated on a hot plate at 130° C. for 18 hours with constant magnetic stirring. The solution was cooled to a temperature below 100° C. Strontium metal (1.752 g, 20.00 mmol) and 2-ethylhexanoicacid (6.1 g, 42.3 mmol) were measured into the hot mixture, which was returned to the hot plate for heating at 140° C. The heated mixture was reacted for half an hour until the strontium metal was completely dissolved. Heating continued for another 3 hours, and the flask was removed from the hot plate. About 60 ml of solvent was evaporated under vacuum at temperatures ranging from 50°–140° C. The solution stood to room temperature. Bismuth 2-ethylhexanoate (Bi22% in hexane, 41.41 g, 43.6 mol) was added into the solution and the concentration of the solution was adjusted to 0.15 mol/kg by addition of ethyl butylate. The total weight of the final solution was 133.3 g.

EXAMPLE 4

Preparation of a 0.2 mol/kg $SrBi_{2.20}Ta_{2.0}O_9$ Solution in Ethyl isovalerate and Ethyl isobutylate

TABLE 4

| Material | Weight | Formula Weight | milimoles | Supplier |
|---|---|---|---|---|
| Tantalum (V) ethoxide | 16.24 g | 406.25 | 40.00 | Strem |
| 2-ethylhexanoic acid | 30.34 g | 144.21 | 210.4 | Aldrich |
| ethyl isovalerate | 40 ml (34.6 g) | 130.19 | 265.5 | Aldrich |
| Strontium metal | 1.752 g | 87.62 | 20.00 | Aldrich |
| 2-ethylhexanoicacid | 6.1 g | 144.21 | 42.3 | Aldrich |
| Bismuth-2-ethylhexanoate in hexane | 41.80 g | B i22% | 44.0 mol | Chemat Tec. |
| ethyl isobutylate | | | adjust to 0.2 mol/kg | Aldrich |

The tantalum (V) ethoxide (16.24 g, 40.00 mmol), 2-ethylhexanoic acid (30.34 g, 210.4 mmol) and ethyl isovalerate (40 ml) were measured into an Erlenmeyer flash equipped with a reflux condenser. The mixture was heated on a hot plate at 150° C. for 18 hours with constant magnetic stirring. The flask was removed from the hot plate and cooled to less than 100° C. Strontium metal (1.752 g, 20.00 mmol) and 2-ethylhexanoic acid (6.1 g, 42.3 mmol) were measured into the hot mixture, which was returned to the hot plated for heating at 150° C. The mixture was allowed to react with heating for a half hour until the strontium metal was completely dissolved. The solution was refluxed for an additional 3 hours. The flask was removed from the hot plate and about 50 ml of solvent was evaporated under vacuum at temperatures ranging from 50°–120° C. The solution stood to room temperature and bismuth 2-ethylhexanoate (Bi22% in hexane, 41.08 g, 44.0 mol) was added into the solution. Solution concentration was adjusted to 0.20 mol/Kg by adding ethyl isovalerate. The total weight of the final solution was 100 g.

EXAMPLE 5

Preparation of a 0.15 mol/kg $SrBi_{2.20}Ta_{2.0}O_9$ Solution in an Ethyl isovalerate and Ethyl isobutylate Solvent System A 0.15 mol/kg solution was prepared by adding ethyl isobutylate to 50 g of the 0.20/kg solution from Example 4. The total weight of the final solution was 66.66 g.

EXAMPLE 6

Preparation of a 0.20 mol/kg $Ba_{0.7}Sr_{0.3}TiO_3$ Solution in Methyl-3-methoxypropionate

TABLE 5

| Material | Weight | Formula Weight | milimoles | Supplier |
|---|---|---|---|---|
| Ti (IV) isopropoxide | 5.69 g | 284.25 | 20.00 | Strem |
| 2-ethylhexanoicacid | 12.69 g | 144.21 | 88.0 | Aldrich |
| Methyl-3-methoxypropionate | 60 ml (60.6 g) | 120.15 | 504.4 | Aldrich |
| Barium metal | 1.923 g | 137.34 | 14 | Aldrich |

TABLE 5-continued

| Material | Weight | Formula Weight | milimoles | Supplier |
|---|---|---|---|---|
| Strontium metal | 0.526 g | 87.62 | 6.00 | Aldrich |
| 2-ethylhexanoicacid | 6.35 g | 144.21 | 44.00 | Aldrich |
| Methyl-3-methoxypropionate | | | Adjust to 0.2 mol/kg | Aldrich |

The titanium (IV) isopropoxide (5.69 g, 20.00 mmol), 2-ethylhexanoicacid (12.69 g, 88.0 mmol) and methyl-3-methoxypropionate (60 ml) were measured into an Erlenmeyer flash equipped with a reflux condenser. The mixture was heated on a hot plate at 150° C. for 19 hours with constant magnetic stirring. The flask was removed from the hot plate and cooled to below 100° C. Barium metal (1.923 g, 14.00 mmol), strontium metal (0.526 g, 6.00 mmol) and 2-ethylhexanoic acid (6.35 g, 44.00 mmol) were measured into the hot mixture. The flask was returned to the hot plate for heating at 140° C., and reacted for half an hour until the barium and strontium metal were completely dissolved. The solution was refluxed for an additional 3 hours. The flask was removed from the hot plate and about 40 ml of solvent was evaporated under vacuum at temperatures ranging from 50°–140° C. The solution stood to room temperature, and concentration of the solution was adjusted to 0.20 mol/Kg by adding methyl-3-methoxypropionate. The total weight of the final solution was 100.0 g.

EXAMPLE 7

Preparation of a 0.20 mol/kg $Ba_{07}Sr_{0.3}TiO_3$ Solution in Ethyl isovalerate

TABLE 6

| Material | Weight | Formula Weight | milimoles | Supplier |
|---|---|---|---|---|
| Titanium (IV) isopropoxide | 5.69 g | 284.25 | 20.00 | Strem |
| 2-ethylhexanoicacid | 12.69 g | 144.21 | 88.0 | Aldrich |
| Ethyl isovalerate | 60 ml (51.8 g) | 130.19 | 398.2 | Aldrich |
| Barium metal | 1.923 g | 137.34 | 14.00 | Aldrich |
| Strontium metal | 0.526 g | 87.62 | 6.00 | Aldrich |
| 2-ethylhexanoicacid | 6.35 g | 144.21 | 44.00 | Aldrich |
| Ethyl isovalerate | | | Adjust to 0.2 mol/kg | Aldrich |

The titanium (IV) isopropoxide (5.69 g, 20.00 mmol), 2-ethylhexanoicacid (12.69 g, 88.0 mmol) and ethyl isovalerate (60 ml) were measured into an Erlenmeyer flask equipped with a reflux condenser. The mixture was heated on a hot plate at 150° C. for 18 hours with constant magnetic stirring. The solution was cooled to 100° C. Barium metal (1.923 g, 14.00 mmol), strontium metal (0.526 g, 6.00 mmol) and 2-ethylhexanoic acid (6.35 g, 44.00 mmol) were measured into the hot mixture. The flask was returned to the hot plate for heating at 140° C., and reacted for one half hour until the barium and strontium metals were completely dissolved. The solution refluxed for an additional 3 hours. The flask was removed from the hot plate, and about 40 ml of solvent was evaporated under vacuum at temperatures ranging from 50°–140° C. The solution stood to room temperature, and solution concentration was adjusted to 0.2 mol/kg by adding ethyl isovalerate. The total weight of the final solution was 1.00 g.

EXAMPLE 8

Production of an Integrated Circuit Capacitor Device

A capacitor 100 was made using an ester-based solution prepared according to Example 1. A conventional four inch diameter polycrystalline p-doped silicon wafer was rinsed with water and dried using a typical RCA water cleaning process. A Pt/Ti electrode (2000 Å/200 Å) was sputtered onto the substrate using a DC magnetron.

A 2 ml aliquot of the 0.2N $SrBi_2Ta_2O_9$ precursor from Example 1 was adjusted to a 0.13N concentration by the addition of ethyl isovalerate, and passed through a 0.2 μm filter. The substrate was spun at 1500 rpm in a conventional spin-coating machine. An eyedropper was used to apply precursor solution to the substrate for thirty seconds while spinning. The precursor-coated substrate was removed from the spin-coating machine and dried in air for two minutes on a 140° hot plate. The substrate was dried in air for an additional four minutes on a second hot plate at 260° C. The substrate can be dried for an additional thirty seconds in oxygen at 725° C. using a HEATPULSE 410 tungsten-halogen lamp heat source apparatus purchased from AG Associates Inc. The tungsten halogen bulbs included eight J208V bulbs (purchased from Ushio of Japan) for a total of 1200 W. The lamp hearing profile included a 100° C./second ramp up to 725° C. from room temperature. The spin-coating and drying procedure was repeated a second time to increase the overall thickness of the dried precursor film.

The substrate (including dried precursor material) was annealed under an oxygen ($O_2$) atmosphere for eighty minutes at 800° C. in a diffusion furnace. This time included a five minute push into the furnace and a five minute pull out of the furnace.

Platinum metal was sputtered to a 2200 Å thickness using a DC magnetron. The substrate was patterned using a conventional negative resist mask and argon ion etching. After removal of the resist, the device was annealed under oxygen at 800° C. for forty minutes including a five minute push into the diffusion furnace and a five minute pull out of the furnace.

Figure 14:
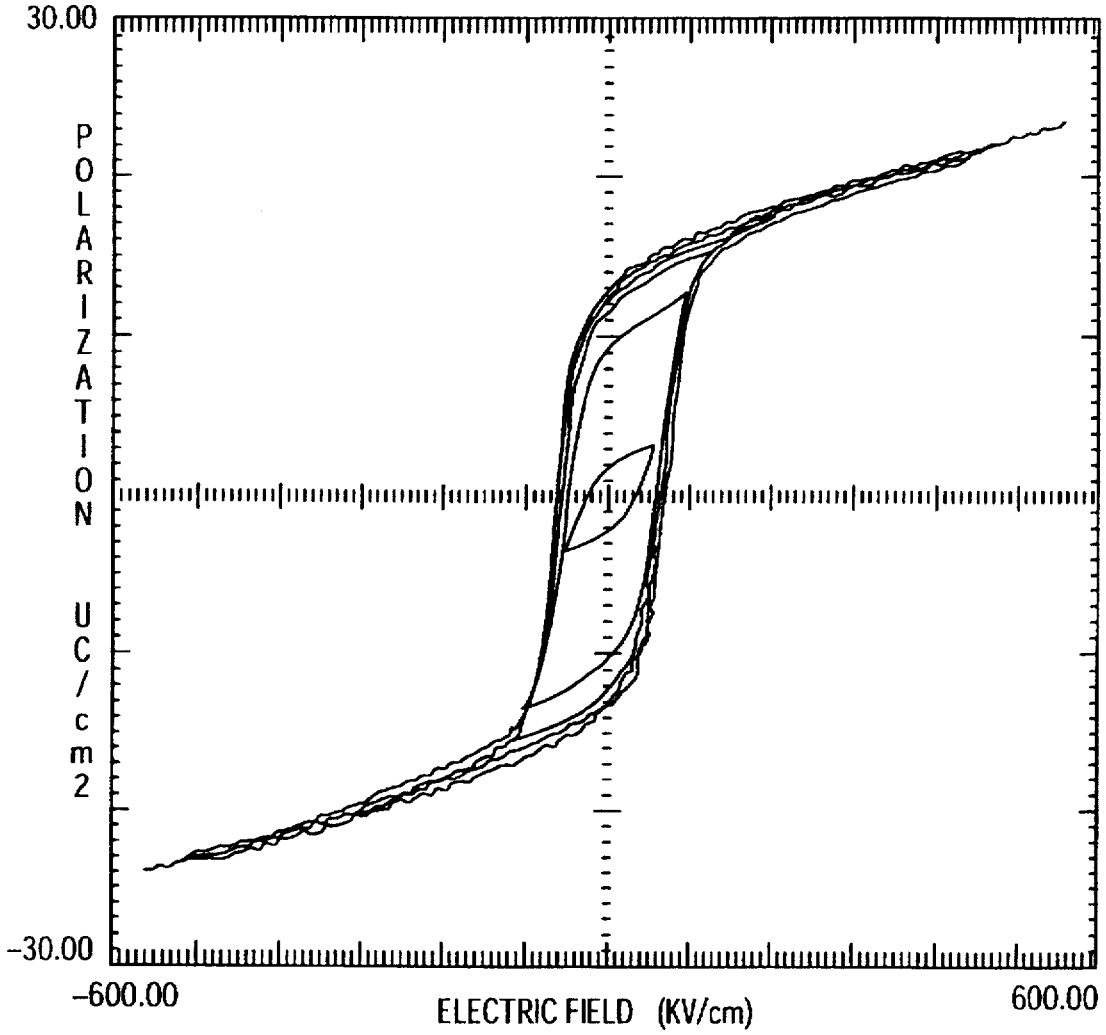
FIG. 14 depicts a polarization hysteresis curve obtained from a metal oxide produced according to the present invention.

FIG. 14 depicts a polarization hysteresis curve for the resultant capacitor. The curve demonstrates excellent ferroelectric performance with a boxy rectangular shape and a 2Pr polarization of about 28 $\mu C/cm^2$.

Those skilled in the art understand that the preferred embodiments described above may be subjected to modifications without departing from the true scope and spirit of the invention. The inventors, accordingly, hereby state their intention to rely upon the Doctrine of Equivalents to protect their full rights in the invention.

We claim:

1. A solution for use in depositing metal oxide films, comprising:

a metal carboxylate portion having at least one metal carboxylate in an effective amount for yielding an oxide of said metal upon annealing of said metal carboxylate portion; and a solvent including an ester having a carboxylate portion including from four to ten-carbon atoms, said solvent comprising more than twenty percent of said solution by weight.

2. The solution as set forth in claim 1 wherein said solvent has a molecular formula

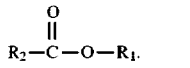

wherein $R_1$ is an aliphatic hydrocarbon chain having from one to five carbon atoms; $R_2$ is an aliphatic hydrocarbon chain having from three to eight carbon atoms; and $R_1$ and $R_2$ together have from five to eleven carbon atoms.

3. The solution as set forth in claim 2 wherein said metal carboxylate portion has a molecular formula

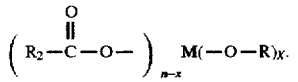

wherein R is an aliphatic carbon chain having from one to five carbon atoms; $R_2$ is an aliphatic carbon chain having from three to nine carbon atoms; M is said metal having valence requirements of n; and n and x are integers such that $n>x\geqq 0$.

4. The solution as set forth in claim 1 wherein said solvent has a molecular formula

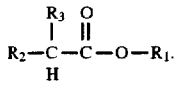

wherein $R_1$ is an aliphatic hydrocarbon chain having from one to five carbon atoms; $R_2$ is an aliphatic hydrocarbon chain having from three to eight carbon atoms; $R_3$ is an aliphatic carbon chain having from one to four carbon atoms; $R_1$ and $R_2$ together have from two to six carbon atoms; and $R_1$, $R_2$, and $R_3$ together have from four to eleven carbon atoms.

5. The solution as set forth in claim 4 wherein said metal carboxylate portion has a molecular formula

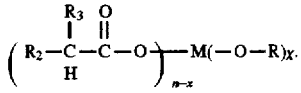

wherein R is an aliphatic carbon chain having from one to five carbon atoms; $R_2$ is an aliphatic carbon chain having from three to nine carbon atoms; $R_3$ is an aliphatic carbon chain having from one to three carbon atoms; M is said metal having valence requirements of n; $R_2$ and $R_3$ together have from two to six carbon atoms; and n and x are integers such that $n>x\geqq 0$.

6. The solution as set forth in claim 1 wherein said solvent has a molecular formula

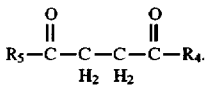

wherein $R_1$ is an aliphatic hydrocarbon chain having from one to five carbon atoms; $R_2$ is an aliphatic hydrocarbon chain having from three to eight carbon atoms; $R_3$ is an aliphatic carbon chain having from one to four carbon atoms; $R_1$ and $R_2$ together have from two to six carbon atoms; and $R_1$, $R_2$, and $R_3$ together have from five to eleven ten atoms.

7. The solution as set forth in claim 6 wherein said metal carboxylate portion has a molecular formula

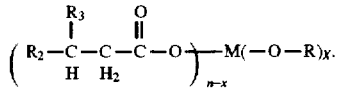

wherein R is an aliphatic carbon chain having from one to five carbon atoms; $R_2$ is an aliphatic carbon chain having from three to nine carbon atoms; $R_3$ is an aliphatic carbon chain having from one to three carbon atoms; M is said metal having valence requirements of n; $R_2$ and $R_3$ together have from two to six carbon atoms; and n and x are integers such that $n>x\geqq 0$.

8. The solution as set forth in claim 1 wherein said solvent has a molecular formula

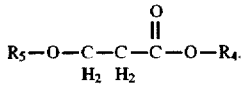

wherein $R_4$ is an aliphatic hydrocarbon chain having from one to four carbon atoms; $R_5$ is an aliphatic hydrocarbon chain having from one to two carbon atoms; and $R_4$ and $R_5$ together have from three to four carbon atoms.

9. The solution as set forth in claim 8 wherein said metal carboxylate portion has a molecular formula

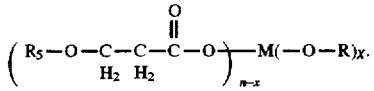

wherein R is an aliphatic carbon chain having from one to five carbon atoms; $R_5$ is an aliphatic carbon chain having from one to two carbon atoms; M is said metal having valence requirements of n; and n and x are integers such that $n>x\geqq 0$.

10. The solution as set forth in claim 1 wherein said solvent has a molecular formula

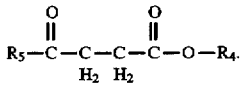

wherein $R_4$ is an aliphatic hydrocarbon chain having from one to four carbon atoms; $R_5$ is an aliphatic hydrocarbon chain having from one to two carbon atoms; and $R_4$ and $R_5$ together have from two to four carbon atoms.

11. The solution as set forth in claim 10 wherein said metal carboxylate portion has a molecular formula

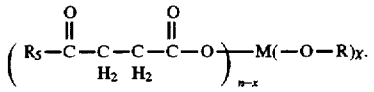

wherein R is an aliphatic carbon chain having from one to five carbon atoms; $R_5$ is an aliphatic carbon chain having from one to two carbon atoms; M is said metal having valence requirements of n; and n and x are integers such that $n>x\geqq 0$.

12. The solution set forth in claim 11 wherein said metal oxide is a perovskite.

13. The solution as set forth in claim 11 wherein said metal oxide is a layered superlattice material.

14. The solution as set forth in claim 13 wherein said layered superlattice material is selected from the group consisting of strontium bismuth tantalate, strontium bismuth niobate, and strontium bismuth niobium tantalate.

15. The solution as set forth in claim 1 wherein said metal carboxylate portion has a molecular formula

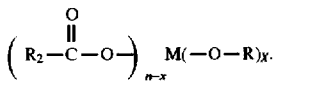

wherein R is an aliphatic carbon chain having from one to five carbon atoms; $R_2$ is an aliphatic carbon chain having from three to nine carbon atoms; M is said metal having valence requirements of n; and n and x are integers such that $n>x\geqq 0$.

16. The solution as set forth in claim 1 wherein said metal carboxylate portion has a molecular formula

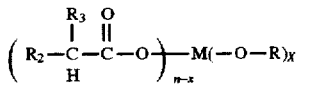

wherein R is an aliphatic carbon chain having from one to five carbon atoms; $R_2$ is an aliphatic carbon chain having from three to nine carbon atoms; $R_3$ is an aliphatic carbon chain having from one to three carbon atoms; M is said metal having valence requirements of n; $R_2$ and $R_3$ together have from two to six carbon atoms; and n and x are integers such that $n>x\geqq 0$.

17. The solution as set forth in claim 1 wherein said metal carboxylate portion has a molecular formula

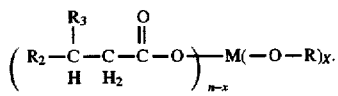

wherein R is an aliphatic carbon chain having from one to five carbon atoms; $R_2$ is an aliphatic carbon chain having from three to nine carbon atoms; $R_3$ is an aliphatic carbon chain having from one to three carbon atoms; M is said metal having valence requirements of n; $R_2$ and $R_3$ together have from two to six carbon atoms; and n and x are integers such that $n>x\geqq 0$.

18. The solution as set forth in claim 1 wherein said metal carboxylate portion has a molecular formula

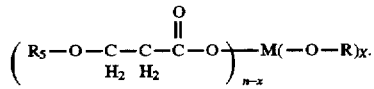

wherein R is an aliphatic carbon chain having from one to five carbon atoms; $R_5$ is an aliphatic carbon chain having from one to two carbon atoms; M is said metal having valence requirements of n; and n and x are integers such that $n>x\geqq 0$.

19. The solution as set forth in claim 1 wherein said metal carboxylate portion has a molecular formula

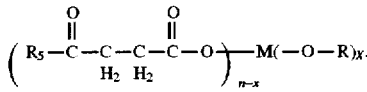

wherein R is an aliphatic carbon chain having from one to five carbon atoms; $R_5$ is an aliphatic carbon chain having from one to two carbon atoms; M is said metal having valence requirements of n; and n and x are integers such that $n>x\geqq 0$.

20. The solution as set forth in claim 1 wherein said solvent portion is selected from the group consisting of ethyl butylate, ethyl isobutylate, ethyl isovalerate, ethyl caproate, ethyl heptanoate, ethyl 2-ethylhexanoate, ethylcaprylate and ethylcaprate, methyl-3-methoxypropionate, ethyl-3-ethoypropionate, and ethyl levulinate.

21. The solution as set forth in claim 1 wherein said metal carboxylate portion includes a plurality of metals in effective amounts for yielding a metal oxide of a desired stoichiometry.

22. The solution as set forth in claim 21 wherein said metal carboxylate portion has a molarity in said solvent portion ranging from 0.1 mol/kg–0.4 mol/kg determined as a stoichiometric amount corresponding to an empirical formula of said desired stoichiometry.

23. The solution as set forth in claim 1 wherein said solution is essentially free of esters having a carboxylate portion with a carbon chain of less than 3 carbons.

24. The solution as set forth in claim 1 wherein said metal carboxylate portion includes a metal alkoxycarboxylate.

25. The solution as set forth in claim 1 wherein said metal carboxylate portion includes a carboxylate ligand having a carbon chain of from five to ten carbon atoms.

26. The solution as set forth in claim 1 wherein said metal carboxylate portion includes an alkaline earth metal.

27. The solution as set forth in claim 1, said solution being essentially free of acetates.

* * * * *

UNITED STATES PATENT AND TRADEMARK OFFICE

CERTIFICATE OF CORRECTION

PATENT NO : 5,788,757

DATED : August 4, 1998

INVENTOR(S) : Hiroto Uchida et al.

It is certified that error appears in the above-identified patent and that said Letters Patent is hereby corrected as shown below:

Col. 17, lines 53-59

Replace "The solution as set forth in claim 1 wherein said solvent has a molecular formula

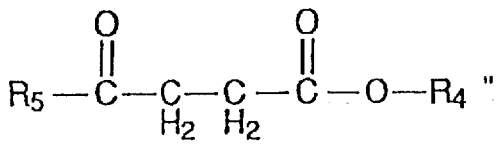

with --The solution as set forth in claim 1 wherein said solvent has a molecular formula

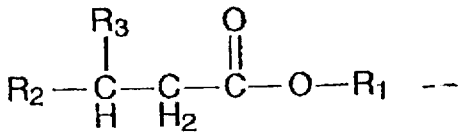

Signed and Sealed this

Twenty-sixth Day of October, 1999

*Attest:*

Q. TODD DICKINSON

*Attesting Officer*

*Acting Commissioner of Patents and Trademarks*